US009285698B2

(12) United States Patent
Uemoto et al.

(10) Patent No.: US 9,285,698 B2
(45) Date of Patent: Mar. 15, 2016

(54) BLACK MAGNETIC IRON OXIDE PARTICLES, MAGNETIC CARRIER FOR ELECTROPHOTOGRAPHIC DEVELOPER AND TWO-COMPONENT DEVELOPER

(75) Inventors: Shinji Uemoto, Otake (JP); Hiromitsu Misawa, Otake (JP); Ryo Iwai, Otake (JP); Naoki Uchida, Otake (JP); Koso Aoki, Otake (JP); Kazuya Fujita, Otake (JP); Kaori Kinoshita, Otake (JP); Kazushi Takama, Otake (JP); Eiichi Kurita, Otake (JP)

(73) Assignee: TODA KOGYO CORPORATION, Hiroshima (JP)

( * ) Notice: Subject to any disclaimer, the term of this patent is extended or adjusted under 35 U.S.C. 154(b) by 457 days.

(21) Appl. No.: 12/484,318

(22) Filed: Jun. 15, 2009

(65) Prior Publication Data

US 2009/0311617 A1 Dec. 17, 2009

(30) Foreign Application Priority Data

Jun. 17, 2008 (JP) ..... 2008-158417
Aug. 1, 2008 (JP) ..... 2008-200027

(51) Int. Cl.
*G03G 9/083* (2006.01)
*G03G 9/107* (2006.01)
*G03G 9/113* (2006.01)

(52) U.S. Cl.
CPC ..... *G03G 9/107* (2013.01); *G03G 9/113* (2013.01); *G03G 9/1135* (2013.01); *G03G 9/1136* (2013.01)

(58) Field of Classification Search
USPC ..... 430/111.1, 111.3, 111.31, 111.32, 430/111.4, 111.41
See application file for complete search history.

(56) References Cited

U.S. PATENT DOCUMENTS

| | | | | |
|---|---|---|---|---|
| 5,643,704 | A * | 7/1997 | Tamura et al. | 430/111.3 |
| 6,136,489 | A * | 10/2000 | Takehara | 430/111.35 |
| 6,506,531 | B1 * | 1/2003 | Hakata et al. | 430/111.33 |
| 2007/0141502 | A1 * | 6/2007 | Aga et al. | 430/111.32 |
| 2007/0254157 | A1 * | 11/2007 | Uchida et al. | 428/403 |

FOREIGN PATENT DOCUMENTS

| | | |
|---|---|---|
| JP | 07-110598 | 4/1995 |
| JP | 07-277738 | 10/1995 |
| JP | 8-095298 | 4/1996 |

(Continued)

OTHER PUBLICATIONS

Notice of Reason for Rejection and English translation in JP 2009-143475 mailed Jun. 11, 2013.
Japanese Office Action and English Translation in JP 2009-179865 mailed Sep. 25, 2013.

*Primary Examiner* — Stewart Fraser
*Assistant Examiner* — Rachel L Zhang
(74) *Attorney, Agent, or Firm* — Nixon & Vanderhye P.C.

(57) ABSTRACT

Black magnetic iron oxide particles having an average particle diameter of 0.05 to 2.0 μm and an electric resistance value at an applied voltage of 100 V of not less than $1\times10^8$ Ω·cm. Also a magnetic carrier for electrophotographic developer having spherical magnetic composite particles obtained by dispersing black magnetic iron oxide particles in a binder resin. The magnetic carrier has an electric resistance value R100 at an applied voltage of 100 V of $1\times10^8$ to $1\times10^{14}$ Ω·cm, and an electric resistance value R300 at an applied voltage of 300 V which satisfies the relationship represented by the formula:

$$0.1 \leq R300/R100 \leq 1.$$

11 Claims, 1 Drawing Sheet

(56) References Cited

FOREIGN PATENT DOCUMENTS

| | | |
|---|---|---|
| JP | 10-293421 | 11/1998 |
| JP | 11-174729 | 7/1999 |
| JP | 2005-316056 | 11/2005 |
| JP | 2007-101731 | 4/2007 |
| JP | 2007-314412 | 12/2007 |
| JP | 2008-090024 | 4/2008 |

* cited by examiner

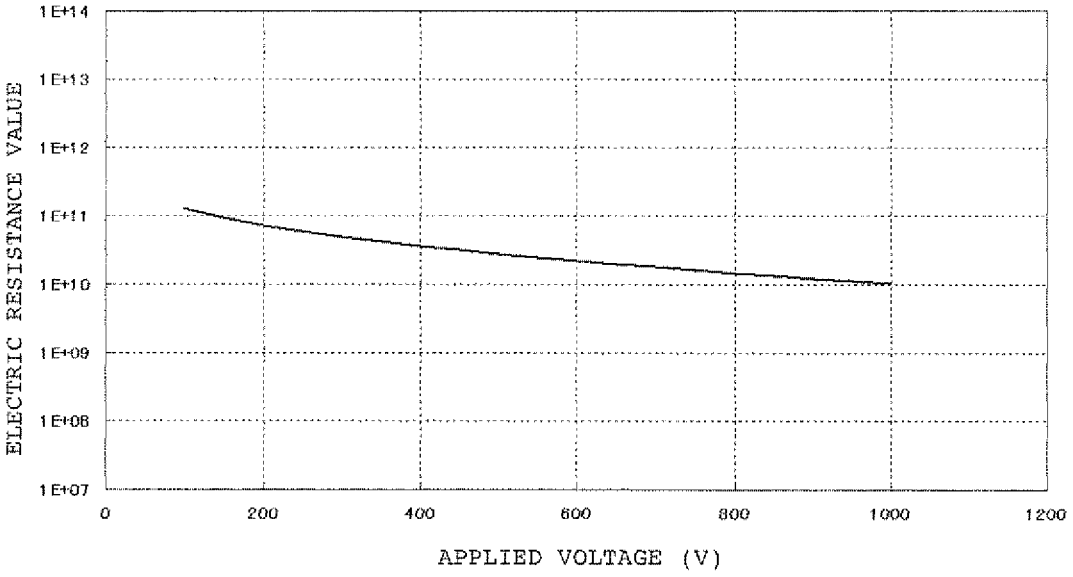
1E+14
1E+13
1E+12
1E+11
1E+10
1E+09
1E+08
1E+07
ELECTRIC RESISTANCE VALUE
0
200
400
600
800
1000
1200
APPLIED VOLTAGE (V)

BLACK MAGNETIC IRON OXIDE PARTICLES, MAGNETIC CARRIER FOR ELECTROPHOTOGRAPHIC DEVELOPER AND TWO-COMPONENT DEVELOPER

BACKGROUND OF THE INVENTION

The present invention relates to black magnetic iron oxide particles which are suitably used as black coloring pigments for paints, resins, printing inks, etc., because of a good blackness thereof, and more particularly, to black magnetic iron oxide particles which are capable of providing toners having a high image density even under high-temperature and high-humidity conditions when used as black magnetic particles for magnetic toners, because they are excellent in electrical characteristics, moisture absorption and dispersibility.

Further, the present invention relates to a magnetic carrier for electrophotographic developer which exhibits a sufficient electric resistance value and a less voltage dependency of the electric resistance value, and is excellent in gradation of obtained images, as well as a two-component developer comprising a toner and the magnetic carrier for electrophotographic developer.

Magnetite particles are typical black pigments, and have been generally used for a long time as a colorant for paints, printing inks, cosmetics, rubber and resin compositions, etc.

In particular, the magnetite particles have been frequently used in one-component type magnetic toners in which composite particles prepared by mixing and dispersing black magnetic iron oxide particles such as magnetite particles in resins are employed as a developing material.

In recent years, with the tendency of a high printing speed and a high image quality of laser beam printers or digital copying machines as well as the development of apparatuses capable of being operated under various environmental conditions, it has been strongly required to enhance properties of magnetic toners as a developer, in particular, provide toners capable of exhibiting a good keeping property of image density even under high-temperature and high-humidity conditions.

In order to meet the above requirements for the magnetic toners, it is also strongly required that the black magnetic iron oxide particles used therein are further improved in properties thereof.

More specifically, in order to obtain toners which are excellent in environmental stability, in particular, keeping property of image density under high-temperature and high humidity conditions, the black magnetic iron oxide particles used therein are required to have not only more excellent electric characteristics such as a sufficient resistance value, but also a low moisture absorption and an excellent environmental stability as well as an excellent dispersibility.

The reason therefor is due to the fact that upon forming a toner image, an image force as a resultant force of an electrostatic attraction force and a magnetic constraint force is exerted on toner particles when the toner particles fly towards a latent image formed on a photosensitive member, and an intensity of the image force is delicately controlled to attain a good image density. Namely, the toner particles having a high resistance value are improved in charging performance and, therefore, tend to readily fly towards the photosensitive member, resulting in a high image density.

In order to control the charging performance of the toner particles, there may be usually used a charge controlling agent. As the other means for controlling the charging performance of the toner particles, there is known the method of controlling an electric resistance value of magnetic iron oxide particles as a pigment component exposed to the surface of the respective toner particles. More specifically, when the electric resistance value of the magnetic iron oxide particles exposed to the surface of the respective toner particles is high, the toner particles tend to be readily charged. On the contrary, when the electric resistance value of the magnetic iron oxide particles exposed to the surface of the respective toner particles is low, an electrostatic charge on the surface of the charged toner particles is leaked through the magnetic iron oxide particles exposed to the surface of the respective toner particles upon stirring in a toner hopper, resulting in reduction in charge amount of the toner particles.

These phenomena tend to become more remarkable under some environmental atmospheres to which the developing device is exposed, in particular, under high-temperature and high-humidity conditions. More specifically, in general, the charging performance of the toner tends to be lowered under high-temperature and high-humidity conditions, resulting in low image density.

Therefore, when the black magnetic iron oxide particles are used as a pigment for the toner particles, it is very important to well control electric characteristics and moisture absorption of the black magnetic iron oxide particles in order to obtain images having a high image density.

As to the electric resistance value of the black magnetic iron oxide particles, it is generally known that since magnetite exhibits electric characteristics of a semiconductor, a high electric resistance value thereof is realized by coating or attaching a high-resistance component (such as high-resistance oxides, hydroxides, dielectric organic substances, hydrophobic organic substances, etc.) on the surface of the respective black magnetic iron oxide particles by a dry or wet method.

Conventionally, it has been attempted to improve various properties of the black magnetic iron oxide particles by incorporating different kinds of elements other than iron thereinto and coating the surface thereof with an inorganic or organic substance.

For example, in Japanese Patent Application Laid-open (KOKAI) No. 2002-72545, there are described iron oxide particles comprising composite iron oxide of aluminum and iron on a surface thereof. Also, in Japanese Patent Application Laid-Open (KOKAI) No. 2005-289673, there are described magnetite particles obtained by subjecting magnetite particles having a coating layer comprising a compound of one or more elements other than iron to mechanochemical treatment.

Further, in Japanese Patent Application Laid-Open (KOKAI) No. 2007-314412, there is described a black magnetic iron oxide whose surface is coated with a surface layer comprising a compound of at least one alkali earth element and an Al element.

In addition, in Japanese Patent Application Laid-Open (KOKAI) No. 7-110598, there are described magnetite particles on the surface of which a co-precipitated product of silica and alumina is deposited.

At present, it has been strongly required to provide black magnetic iron oxide particles exhibiting a high electric resistance in a high voltage range, a low moisture absorption and an excellent dispersibility. However, such black magnetic iron oxide particles capable of satisfying these requirements have not been obtained until now.

That is, in the conventional techniques described in Japanese Patent Application Laid-open (KOKAI) Nos. 2002-72545 and 2005-289673, the electric resistance value of the particles has been noticed. However, the electric field applied to the toner particles within a printer in which the toner particles are actually used, is generally a high electric field though it varies depending upon the kind of printer used. As described in the below-mentioned Comparative Examples, these techniques may still fail to attain a sufficient electric resistance in such a high electric field.

In the conventional technique described in Japanese Patent Application Laid-open (KOKAI) No. 2007-314412, the electric resistance in a high voltage range has been noticed. However, as described in the below-mentioned Comparative Examples, the above technique may also still fail to attain a sufficient electric resistance in such a high voltage range.

The technique described in Japanese Patent Application Laid-Open (KOKAI) No. 7-110598 aims at obtaining magnetite particles having not only an excellent fluidity and a low oil absorption but also an excellent charging stability. However, the conventional technique may also fail to provide magnetite particles exhibiting a sufficiently high electric resistance in a high voltage range.

In order to achieve a high image density and a good keeping property of the high image density, it is important that a pigment used in the toner exhibits a high electric resistance value, and the electric resistance value of the pigment is also kept high even in a high voltage range. More specifically, even though the pigment exhibits a high electric resistance value in a low voltage range, if the electric resistance value is low in an electric field actually used, an electrostatic charge present on the surface of the toner tends to leak out through the pigment exposed to the surface of the toner as a leak site, resulting in low charge amount on the toner and, therefore, considerable deterioration in image density.

Thus, the conventional black magnetic iron oxide particles described in the above patent publications all have failed to satisfy the requirement of enhancing the electric resistance value in a high voltage range which has been strongly needed at the present time.

On the other hand, the conventional electrophotographic developing methods tend to suffer from the following problems.

As is well known in the art, in electrophotographic developing methods, there has been generally used a photosensitive member comprising a photoconductive material such as selenium, OPC (organic semiconductor), α-Si or the like, in which an electrostatic latent image is formed on the photosensitive member by various means, and then by using a magnetic brush method or the like, a toner having a polarity reverse to that of the latent image is attached thereon by an electrostatic force to form the developed image.

In the developing step of the above methods, there is used a developer comprising a toner and a carrier. The support particles called a carrier serve for imparting an appropriate positive or negative electrical quantity to the toner by frictional electrification, and transferring the toner to a developing zone near the surface of the photosensitive member on which a latent image is formed, through a developing sleeve in which magnets are accommodated, using a magnetic force thereof.

In recent years, the electrophotographic developing method has been widely applied to copying machines or printers. In these apparatuses, it has been demanded to meet various requirements including not only reproduction of thin lines, small characters, photographs, color originals or the like. With the development of copying machines and printers having a higher performance, a higher image quality and a higher copying or printing speed, it has been required to improve various properties of a developer used therein.

As is well known in the art, the developer has also been required to have such a durability that electric properties of the toner and the carrier are not significantly changed during use. For example, there tends to be caused such an undesirable phenomenon that a toner is firmly deposited onto the surface of the carrier particles, so that the charging property inherent to the carrier particles is lost (i.e., a so-called spent toner), or such a phenomenon that a resin coating layer formed on the surface of the respective carrier particles is peeled off with the passage of time, so that leak sites are formed thereon, thereby failing to appropriately charge the toner.

The carrier is required to have a certain suitable electric resistance value ranging from about $1\times10^{8}$ to $1\times10^{16}$ Ω·cm. More specifically, when the carrier has an electric resistance value as low as $1\times10^{6}$ Ω·cm like iron powder carrier, there tend to arise the problems such as attachment of the carrier to image-bearing portions of a photosensitive member owing to injection of electric charges from a sleeve, and occurrence of defective latent images or lack of obtained images owing to escape of latent image-forming charges through the carrier. On the other hand, when the thickness of the insulating resin coating layer is increased, the electric resistance value of the carrier tends to become too high, so that charges on the carrier tend to hardly leak out, and the toner has a very high charge amount. As a result, although the image having a sharp edge is obtained, there tends to arise such a problem that the image having a large area shows a considerably low image density at a central portion thereof.

When the electric resistance value of the carrier has a large voltage dependency, the obtained image tends to generally has no gradation, so that even when using the carrier for a developer in copying machines or printers, it may be difficult to obtain images having a high image quality, and the applications thereof tend to be limited.

The iron powder carrier or ferrite carrier is usually used in the form of resin-coated particles. However, since the iron powder carrier has a true density as large as 7 to 8 g/cm$^3$ whereas the ferrite carrier has a true density as large as 4.5 to 5.5 g/cm$^3$, a large driving force is required for stirring these carriers in a developing device, resulting in significant mechanical damage to the device, occurrence of spent toner as well as deterioration of the charging property itself and facilitated damage to the photosensitive member. Further, since the adhesion between the surface of the iron powder carrier or ferrite carrier and the coating resin is not good, the coating resin tends to be gradually peeled off during use with the time, thereby causing variation in the charging property. As a result, the problems such as formation of defective images and adhesion of the carrier to the images tend to be caused.

The carrier of a magnetic material-dispersed type comprising spherical magnetic composite particles formed from magnetic iron oxide particles and a phenol resin as described in Japanese Patent Application Laid-Open (KOKAI) No. 2-220068 has a small true density as compared to the iron powder carrier or ferrite carrier and, therefore, exhibits an excellent durability against peeling of the coating resin owing to a less amount of energy upon impingement between the toner and carrier.

However, the carrier of a magnetic material-dispersed type has a low electric resistance value, and the electric resistance value exhibits a large voltage dependency. In addition, even though the carrier is coated with various resins to improve the electric resistance, when the resin-coated carrier is actually subjected to printing operation in recent copying machines and printers having such a tendency toward high copying or printing speed, high performance and high image quality, and further when the resin coating layer thereof suffers from abrasion, etc., there tend to arise the problems such as leak of electric charges upon development and poor gradation of obtained images owing to a large voltage dependency of the electric resistance value.

In particular, in recent years, the developer tends to be required to show a good durability over a whole service life of maintenance-free machines. Therefore, it is strongly required that the carrier of a magnetic material-dispersed type has a sufficient electric resistance, and the electric resistance of the magnetic carrier has a less voltage dependency.

Hitherto, as to the carrier of a magnetic material-dispersed type, there are known the technique of controlling an electric resistance value of the carrier by coating a surface of the respective spherical magnetic composite particles with a melamine resin (Japanese Patent Application Laid-Open (KOKAI) No. 3-192268); the technique of controlling an electric resistance value of the carrier by forming a coating layer comprising a cured copolymer resin obtained from one or more kinds of resins and a phenol resin on the surface of the respective spherical magnetic composite particles (Japanese Patent Application Laid-Open (KOKAI) No. 9-311505); the technique of controlling an electric resistance value of a carrier by incorporating a non-magnetic iron compound in the surface of respective spherical magnetic composite particles (Japanese Patent Application Laid-Open (KOKAI) Nos. 8-6303 and 2003-295523); carriers comprising magnetic iron oxide on the surface of which composite iron oxide of aluminum and iron is present (Japanese Patent Application Laid-Open (KOKAI) Nos. 2002-72545 and 2008-90012); etc.

In the techniques described in Japanese Patent Application Laid-Open (KOKAI) Nos. 3-192268 and 9-311505, the electric resistance values of these carriers are increased. However, since the carriers used in these techniques are not in the form of ferromagnetic compound particles whose surface is coated with an Al compound, the electric resistance thereof tends to be considerably lowered when a high voltage is applied thereto, i.e., tends to have a large voltage dependency.

Also, in the techniques described in Japanese Patent Application Laid-Open (KOKAI) Nos. 8-6303 and 2003-295523, it is possible to obtain a carrier having a high electric resistance value. However, since magnetic iron oxide particles whose surface is coated with an Al compound are not used as the ferromagnetic compound, the electric resistance value of the carrier tends to have a large voltage dependency.

In addition, in the techniques described in Japanese Patent Application Laid-Open (KOKAI) Nos. 2002-72545 and 2008-90012, it is possible to increase the electric resistance value of the carriers to some extent. However, as shown in the below-mentioned Comparative Examples, the carriers may fail to exhibit a sufficiently high electric resistance value.

SUMMARY OF THE INVENTION

In view of the above conventional problems, a first object of the present invention is to provide a black magnetic iron oxide pigment which is capable of forming a toner exhibiting a high image density under high-temperature and high-humidity conditions and is improved in keeping property of the image density.

Also, a second object of the present invention is to provide a spherical magnetic composite carrier which exhibits a high electric resistance and is highly controlled in voltage dependency of the electric resistance.

As a result of the present inventors' earnest study in view of the above objects, it has been found that the black magnetic iron oxide particles obtained according to the present invention are capable of exhibiting a high electric resistance value under a high voltage. The present invention has been attained on the basis of the finding.

The first object of the present invention can be achieved by the following Inventions.

That is, the present invention provides black magnetic iron oxide particles having an average particle diameter of 0.05 to 2.0 μm and an electric resistance value RM100 at an applied voltage of 100 V of not less than $1\times10^8$ Ω·m (Invention 1).

Also, the present invention provides the black magnetic iron oxide particles as described in Invention 1, wherein a surface of the respective black magnetic iron oxide particles is coated with one or more elements selected from the group consisting of Al, Mg, Mn, Zn, Ni, Cu, Ti and Si, and the elements are present in an amount of 0.3 to 4.5% by weight, on the surface of the respective black magnetic iron oxide particles (Invention 2).

Further, the present invention provides the black magnetic iron oxide particles as described in Invention 1 or 2, wherein the black magnetic iron oxide particles have a water absorption Ma0.9 of not more than 15 mg/g (Invention 3).

Further, the present invention provides the black magnetic iron oxide particles as described in any one of Invention 1 to 3, wherein the black magnetic iron oxide particles have an electric resistance value RM10 at an applied voltage of 10 V which satisfies the relationship represented by the formula:

$$0.5 \le RM100/RM10 \le 1 \quad \text{(Invention 4).}$$

The second object of the present invention can be achieved by the following Inventions.

That is, the present invention provides a magnetic carrier for electrophotographic developer comprising spherical magnetic composite particles obtained by dispersing black magnetic iron oxide particles in a binder resin, wherein the magnetic carrier has an electric resistance value R100 at an applied voltage of 100 V of $1\times10^8$ to $1\times10^{14}$ Ω·m, and an electric resistance value R300 at an applied voltage of 300 V which satisfies the relationship represented by the formula:

$$0.1 \le RM300/RM100 \le 1 \quad \text{(Invention 5).}$$

Also, the present invention provides the magnetic carrier for electrophotographic developer as described in Invention 5, wherein the black magnetic iron oxide particles are the black magnetic iron oxide particles as defined in any one of Inventions 1 to 4 (Invention 6).

Further, the present invention provides the magnetic carrier for electrophotographic developer as described in Invention 5 or 6, wherein the binder resin is a phenol resin (Invention 7).

Further, the present invention provides the magnetic carrier for electrophotographic developer as described in any one of Inventions 5 to 7, wherein a surface coating layer mainly comprising a resin is formed on a surface of the respective spherical magnetic composite particles (Invention 8).

Further, the present invention provides a two-component electrophotographic developer comprising the magnetic carrier for electrophotographic developer as defined in any one of Inventions 5 to 8 (Invention 9)

BRIEF DESCRIPTION OF THE DRAWINGS

FIG. 1 is a graph showing the relationship between an electric resistance value and an applied voltage of the spherical magnetic composite particles obtained in Example 2-1.

DETAILED DESCRIPTION OF THE INVENTION

The present invention is described in detail below.

First, the black magnetic iron oxide particles according to Invention 1 are explained. The particle shape of the black magnetic iron oxide particles according to the present invention is not particularly limited. The black magnetic iron oxide particles may have a hexahedral shape, an octahedral shape, a polyhedral shape, a granular shape, a spherical shape, etc.

The black magnetic iron oxide particles of the present invention comprise core particles and a surface layer formed on the respective core particles. The "surface layer" means a portion of the respective magnetic iron oxide particles except for an Fe-containing portion which extends from a center of each particle toward the surface thereof. Also, the "core particles" mean an inside portion of the respective black magnetic iron oxide particles except for the surface layer.

The surface layer of the black magnetic iron oxide particles according to the present invention is a uniform layer formed on the surface of the respective particles which comprises a metal compound of one or more elements selected from the group consisting of Al, Mg, Zn, Ni, Cu, Ti and Si.

In the black magnetic iron oxide particles of the present invention, the content of the one or more elements selected from the group consisting of Al, Mg, Zn, Ni, Cu, Ti and Si which are present in the surface layer of the respective black magnetic iron oxide particles is not less than 0.3% by weight and not more than 4.5% by weight on the basis of a whole weight of the black magnetic iron oxide particles. When the content of the one or more elements present in the surface layer is less than 0.3% by weight, the resultant black magnetic iron oxide particles tend to exhibit a low electric resistance value. When the content of the one or more elements present in the surface layer is more than 4.5% by weight, the resultant black magnetic iron oxide particles tend to exhibit a undesirably high moisture absorption. The content of the one or more elements present in the surface layer is preferably 0.5 to 4.0% by weight and more preferably 0.6 to 3.5% by weight.

The black magnetic iron oxide particles of the present invention have an electric resistance value RM100 of not less than $1.0\times10^{8}$ Ω·m upon applying a D.C. voltage of 100 V thereto. When the electric resistance value RM100 of the black magnetic iron oxide particles upon applying a D.C. voltage of 100 V thereto is less than $1.0\times10^{8}$ Ω·m, the black magnetic iron oxide particles tend to exhibit an insufficient electric resistance at a high electric field. The electric resistance value RM100 of the black magnetic iron oxide particles upon applying a D.C. voltage of 100 V thereto is preferably not less than $3.0\times10^{8}$ Ω·m and more preferably $3.0\times10^{8}$ to $1.0\times10^{15}$ Ω·m. The upper limit of the electric resistance value RM100 of the black magnetic iron oxide particles upon applying a D.C. voltage of 100 V thereto is not particularly limited, and is generally about $1.0\times10^{17}$ Ω·m.

The black magnetic iron oxide particles of the present invention preferably have an electric resistance value RM10 of not less than $1.0\times10^{8}$ Ω·m and more preferably $3.0\times10^{8}$ to $1.0\times10^{15}$ Ω·m upon applying a D.C. voltage of 10 V thereto. Meanwhile, the upper limit of the electric resistance value RM10 of the black magnetic iron oxide particles upon applying a D.C. voltage of 10 V thereto is not particularly limited, and is generally about $1.0\times10^{17}$ Ω·m.

In the present invention, the relationship between the electric resistance value RM10 at an applied voltage of 10 V and the electric resistance value RM100 at an applied voltage of 100 V (RM100/RM10) of the magnetic iron oxide particles preferably satisfies the following formula:

$$0.5 \le RM100/RM10 \le 1.$$

When the ratio of RM100/RM10 is less than 0.5, the electric resistance value of the black magnetic iron oxide particles tend to have a large voltage dependency when used as a magnetic carrier for electrophotographic developer. The black magnetic iron oxide particles having a ratio of RM100/RM10 of more than 1.0 may be difficult to industrially produce. The ratio of RM100/RM10 of the black magnetic iron oxide particles is more preferably 0.6 to 0.95.

The black magnetic iron oxide particles of the present invention have an average particle diameter of 0.05 to 2.0 μm and preferably 0.07 to 0.50 μm. When the average particle diameter of the black magnetic iron oxide particles is less than 0.05 μm, it may be difficult to well disperse the obtained pigment in toner particles when used in a toner. When the average particle diameter of the black magnetic iron oxide particles is more than 2.0 μm, the number of magnetic particles contained in the toner particles tends to be comparatively reduced, resulting in poor tinting strength. The average particle diameter of the black magnetic iron oxide particles of the present invention is more preferably 0.09 to 0.40 μm.

The black magnetic iron oxide particles of the present invention preferably have a water absorption Ma0.9 of not more than 15 mg/g. When the water absorption Ma0.9 of the black magnetic iron oxide particles is more than 15 mg/g, the black magnetic iron oxide particles tend to exhibit an excessively high moisture absorption and, therefore, tends to be deteriorated in environmental stability. The water absorption Ma0.9 of the black magnetic iron oxide particles is more preferably 3.0 to 12.0 mg/g.

The black magnetic iron oxide particles of the present invention preferably have a BET specific surface area of 3.0 to 20 $m^2/g$.

Next, the process for producing the black magnetic iron oxide particles according to the present invention is described.

The black magnetic iron oxide particles of the present invention may be produced as follows. That is, magnetite core particles are produced by an ordinary method, and then a slurry comprising the core particles is maintained in a temperature range of 70 to 95° C. When using an Al element as the element to be incorporated in the surface layer, an aluminum salt is added to the slurry at a rate of not more than 0.015% by weight/min based on the weight of the core particles while controlling a pH value of the slurry to the range of 8.0 to 9.0. The resulting slurry is aged for 30 min or longer, and then controlled in pH thereof, and further subjected to water-washing and drying by ordinary methods, thereby obtaining the aimed black magnetic iron oxide particles. When using any of Mg, Mn, Zn, Ni, Cu, Ti and Si elements as the element to be incorporated in the surface layer, a salt of the respective metal elements is added to the slurry at a rate of not more than 0.015% by weight/min based on the weight of the core particles while controlling a pH value of the slurry to the range of 9.5 to 10.5 for Mg element, 8.0 to 9.0 for Mn element, 8.0 to 9.0 for Zn element, 7.5 to 8.5 for Ni element, 6.5 to 7.5 for Cu element, 8.0 to 9.0 for Ti element or 6.5 to 7.5 for Si element. The resulting slurry is aged for 30 min or longer, and then controlled in pH thereof, and further subjected to water-washing and drying by ordinary methods, thereby obtaining the aimed black magnetic iron oxide particles.

As described above, the core particles used for obtaining the black magnetic iron oxide particles of the present invention may be selected from those particles having various shapes and particle diameters from the standpoints of magnetic properties, dispersibility, etc., which are required as a black magnetic pigment, and may be produced by various methods. In order to effectively achieve the objects of the present invention, from the standpoint of uniformly performing the below-mentioned surface treatment, the slurry comprising the core particles preferably include none of substances which tend to prohibit the surface treatment, such as, for example, unreacted fine iron hydroxide particles.

As described above, the slurry comprising the core particles can be obtained by various methods. For example, by controlling the pH value of a ferrous ($Fe^{2+}$) aqueous solution during an oxidation reaction thereof to a predetermined suitable value, there can be obtained the core particles having an octahedral shape, a polyhedral shape, a spherical shape or an irregular shape. In addition, by suitably adjusting conditions for particle growth during the oxidation reaction, there can be obtained the core particles having a desired particle diameter. Further, the core particles having a well-controlled surface smoothness can be produced by suitably controlling the conditions for particle growth at an end stage of the oxidation reaction or by adding a silica component, an aluminum component or a calcium component, or compounds which tend to form a spinel ferrite structure, such as zinc and magnesium compounds, to the slurry, as generally known in the art.

As to the ferrous ($Fe^{2+}$) aqueous solution, there may be used, for example, aqueous solutions of ordinary ion compounds such as ferrous sulfate and ferrous chloride. In addition, as the alkali solution which is used for obtaining the iron hydroxide or serves as a pH modifier, there may be used aqueous solutions of sodium hydroxide, sodium carbonate, etc. The respective raw materials may be appropriately selected in view of economy or reaction efficiency.

The pH of the slurry used in surface treatment with Al is preferably 8.0 to 9.0 and more preferably 8.2 to 8.8. When the pH of the slurry is less than 8.0, the Al component may fail to form a coating layer on the surface of the respective core particles, and tends to be precipitated by itself in the form of an Al compound, so that the resulting particles tend to exhibit an undesirably low electric resistance value, a high BET specific surface area value and a high moisture absorption. When the pH of the slurry is more than 9.0, the Al component may also fail to form a coating layer on the surface of the respective core particles, and tends to be precipitated by itself in the form of an Al compound, so that the resulting particles tend to exhibit an undesirably low electric resistance value, a high BET specific surface area value and a high moisture absorption. The pH of the slurry used in surface treatment with Mg is preferably 9.5 to 10.5; the pH of the slurry used in surface treatment with Mn is preferably 8.0 to 9.0; the pH of the slurry used in surface treatment with Zn is preferably 8.0 to 9.0; the pH of the slurry used in surface treatment with Ni is preferably 7.5 to 8.5; the pH of the slurry used in surface treatment with Cu is preferably 6.5 to 7.5; the pH of the slurry used in surface treatment with Ti is preferably 8.0 to 9.0; and the pH of the slurry used in surface treatment with Si is preferably 6.5 to 7.5. When the pH of the slurry used in surface treatment with the respective elements is out of the above-specified ranges, the resulting particles tend to exhibit an undesirably low electric resistance value and a high moisture absorption.

The temperature of the slurry used in the surface treatment with Al, Mg, Mn, Zn, Ni, Cu, Ti or Si component, is preferably 70 to 95° C. When the temperature of the slurry is less than 70° C., the resulting particles tend to exhibit an undesirably high BET specific surface area value, and the slurry temperature less than 70° C. also tends to be undesirable from the viewpoint of moisture absorption. The upper limit of the temperature of the slurry is not particularly limited. However, since the slurry is in the form of an aqueous slurry, the upper limit of the temperature of the slurry is about 95° C. in view of a good productivity and low costs.

The velocity of addition of the metal compound to the slurry comprising the core particles is preferably not more than 0.015% by weight/min and more preferably not more than 0.01% by weight/min in terms of the metal element based on the weight of the core particles. When the velocity of addition of the metal compound to the slurry is more than 0.015% by weight/min in terms of the metal element, the metal compound may fail to form a coating layer on the surface of the respective core particles, and tends to be precipitated by itself, so that the resulting particles tend to exhibit a low electric resistance value, a high BET specific surface area value and a high moisture absorption. The lower limit of the velocity of addition of the metal compound to the slurry is not particularly limited, and is 0.002% by weight/min in view of a productivity thereof.

After adding the metal compound, the resulting slurry is preferably aged for 30 min or longer to uniformly treat the surface of the respective core particles with the metal compound. The upper limit of the aging time of the slurry is not particularly limited, and is about 240 min in view of productivity thereof. In addition, the slurry is preferably intimately stirred upon the aging.

After being aged, the pH of the slurry is preferably controlled to the range of 4.0 to 10.0. When the pH of the slurry is less than 4.0, it may be difficult to form a uniform metal compound layer on the surface of the respective core particles. When the pH of the slurry is more than 10.0, it may also be difficult to form a uniform metal compound layer on the surface of the respective core particles. Upon controlling the pH, the slurry is preferably intimately stirred.

After the reaction, the resultant particles may be subjected to water-washing and drying by ordinary methods.

In the black magnetic iron oxide particles of the present invention, an outside (surface layer) of the respective core particles thereof is uniformly coated with the Al compound, so that the resulting particles can exhibit a high electric resistance upon applying a high voltage thereto. In fact, the particles obtained by adding an Al component and an alkali earth metal component to the synthesized magnetite particles to treat the surface of the respective magnetite particles with these components (Japanese Patent Application Laid-Open (KOKAI) No. 2007-314412) or the particles having a composite iron oxide layer on the surface thereof (Japanese Patent Application Laid-Open (KOKAI) Nos. 2005-289673 and 2002-72545) which have been past filed by the present inventors, tend to exhibit an insufficient electric resistance upon applying a high voltage, e.g., 100 V, thereto. The reason why the black magnetic iron oxide particles of the present invention can exhibit a high electric resistance upon application of a high voltage thereto is considered by the present inventors as follows. That is, it is considered by the present inventors that an insulating layer of the Al component in the form of a void-free, uniform and film-like hydroxide layer or oxide hydroxide layer can be produced on the surface of the respective core particles.

In particular, when the black magnetic iron oxide particles of the present invention are used as a pigment for a toner, it is possible to obtain a high image density as well as exhibit a high electric resistance value upon application of a high voltage thereto. The black magnetic iron oxide particles of the present invention is more suitably used in the applications in which it is required to obtain images having a high image density even under high-temperature and high-humidity conditions.

Next, the magnetic carrier for electrophotographic developer according to Invention 5 is explained.

When measuring the electric resistance value of the magnetic carrier for electrophotographic developer according to the present invention, the electric resistance value R100 thereof at an applied voltage of 100 V is $1\times10^{8}$ to $1\times10^{14}$ Ω·m. When the electric resistance R100 at an applied voltage of 100 V of the magnetic carrier is less than $1\times10^{8}$ Ω·m, there tend to arise the problems such as attachment of the magnetic carrier to image-bearing portions of a photosensitive member owing to injection of electric charges from a sleeve, and occurrence of detective latent images or lack of obtained images owing to escape of latent image-forming electric charges through the carrier. The magnetic carrier having an electric resistance value R100 of more than $1.0\times10^{14}$ Ω·m may be difficult to industrially produce. The electric resistance value R100 at an applied voltage of 100 V of the magnetic carrier is preferably $5.0\times10^{8}$ to $5.0\times10^{13}$ Ω·m and more preferably $6.0\times10^{8}$ to $1.0\times10^{13}$ Ω·m.

When measuring the electric resistance value of the magnetic carrier for electrophotographic developer according to the present invention, the electric resistance R300 thereof at an applied voltage of 300 V is preferably $1\times10^{8}$ to $1.0\times10^{14}$ Ω·m.

In the magnetic carrier for electrophotographic developer according to the present invention, the electric resistance value R100 at an applied voltage of 100 V and the electric resistance value R300 at an applied voltage of 300 V satisfies the relationship represented by the following formula:

$$0.1 \leq R300/R100 \leq 1.0.$$

When the ratio of R300/R100 is less than 0.1, it is meant that the values of R300 and R100 both are large, so that it may be difficult to reduce a voltage dependency of the electric resistance value. The magnetic carrier having a ratio of R300/R100 of more than 1.0 may be difficult to industrially produce. The ratio of R300/R100 of the magnetic carrier is preferably 0.15 to 0.80 and more preferably 0.20 to 0.60.

The magnetic carrier for electrophotographic developer according to the present invention preferably has an average particle diameter of 10 to 100 μm. When the average particle diameter of the magnetic carrier is less than 10 μm, the magnetic carrier tends to suffer from secondary agglomeration. When the average particle diameter of the magnetic carrier is more than 100 μm, the magnetic carrier tends to be deteriorated in mechanical strength, and may also fail to obtain clear images. The average particle diameter of the magnetic carrier is more preferably 20 to 70 μm.

The magnetic carrier for electrophotographic developer according to the present invention preferably has a specific gravity of 2.5 to 4.5 and more preferably 2.5 to 4.2.

The magnetic carrier for electrophotographic developer according to the present invention preferably has a saturation magnetization value of 20 to 100 $Am^2$/kg and more preferably 40 to 85 $Am^2$/kg.

The magnetic carrier for electrophotographic developer according to the present invention preferably has a water adsorption Ma0.9 of 0.5 to 10 mg/g. The magnetic carrier having a water adsorption Ma0.9 of less than 0.5 mg/g may be difficult to industrially produce. When the water adsorption Ma0.9 of the magnetic carrier is more than 10 mg/g, the magnetic carrier tends to adsorb an excessively large amount of water therein, in particular, tends to be undesirably lowered in charging amount, resulting in deterioration of image density. The water absorption Ma0.9 of the magnetic carrier is more preferably 1.5 to 9.0 mg/g.

The magnetic carrier for electrophotographic developer which is obtained by forming a surface coating layer mainly comprising a resin on the surface of the respective spherical magnetic composite particles according to the present invention preferably has an electric resistance value R100 at an applied voltage of 100 V of $1.0\times10^{8}$ to $1.0\times10^{16}$ Ω·m. When the electric resistance R100 at an applied voltage of 100 V of the magnetic carrier is more than $1\times10^{16}$ Ω·m, although the image having a sharp edge is obtained, electric charges on the carrier tend to hardly leak out, and the charging amount of the toner tends to be excessively large. As a result, there tends to arise such a problem that the image having a large area shows a considerably low image density at a central portion thereof. The electric resistance value R100 at an applied voltage of 100 V of the magnetic carrier is more preferably $1.0\times10^{9}$ to $5.0\times10^{15}$ Ω·m.

When measuring the electric resistance value of the magnetic carrier for electrophotographic developer according to the present invention, the electric resistance value R300 thereof at an applied voltage of 300 V is preferably $1\times10^{8}$ to $1\times10^{16}$ Ω·m.

In the magnetic carrier for electrophotographic developer according to the present invention, the electric resistance value R100 thereof at an applied voltage of 100 V and the electric resistance value R300 thereof at an applied voltage of 300 V has such a relationship that the ratio of (R300/R100) is preferably 0.10 to 1.0, more preferably 0.30 to 0.90 and still more preferably 0.40 to 0.80.

Next, the process for producing the magnetic carrier for electrophotographic developer according to the present invention is described.

The spherical magnetic composite particles constituting the magnetic carrier may be produced by reacting a phenol compound with an aldehyde compound under the co-existence of the black magnetic iron oxide particles in the presence of a basic catalyst in an aqueous medium.

First, the black magnetic iron oxide particles used in the process of the present invention are described. The black magnetic iron oxide particles used as the raw material upon production of the magnetic carrier for electrophotographic developer are not particularly limited as long as the above magnetic carrier for an electrophotographic developer can be produced therefrom, but the black magnetic iron oxide particles of Invention 1 as defined above are preferably used. The properties and the production method of the black magnetic iron oxide particles are the same as described above.

The surface of the respective magnetic iron oxide particles used in the present invention is preferably previously subjected to lipophilic treatment. With such a lipophilic treatment, it is possible to more readily obtain a magnetic carrier having a spherical shape.

The lipophilic treatment may be suitably performed by the method of treating the magnetic iron oxide particles with a silane coupling agent or a titanate coupling agent, or the method of dispersing the magnetic iron oxide particles in an aqueous medium comprising a surfactant to allow the surfactant to be adsorbed on the particles.

Examples of the silane coupling agent include those having a hydrophobic group, an amino group or an epoxy group. Specific examples of the silane coupling agent having a hydrophobic group include vinyl trichlorosilane, vinyl triethoxysilane and vinyl-tris(-methoxy)silane. Specific examples of the silane coupling agent having an amino group include -aminopropyl triethoxysilane, N-(aminoethyl)-aminopropyl trimethoxysilane, N-(aminoethyl)-aminopropylmethyl dimethoxysilane and N-phenyl-aminopropyl trimethoxysilane. Specific examples of the silane coupling agent having an epoxy group include -glycidoxypropylmethyl diethoxysilane, -glycidoxypropyl trimethoxysilane and -(3,4-epoxycyclohexyl)trimethoxysilane.

As the titanate coupling agent, there may be used isopropyl triisostearoyl titanate, isopropyl tridodecylbenzenesulfonyl titanate, isopropyl tris(dioctylpyrophosphate)titanate or the like.

As the surfactant, there may be used commercially available surfactants. Among these surfactants, those surfactants having a functional group capable of being bonded to a hydroxyl group in the magnetic iron oxide particles or on the surface thereof are suitably used, and the ionicity of the surfactants is preferably cationic or anionic.

Although the objects of the present invention can be achieved by using any of the above lipophilic treatments, from the viewpoint of good adhesion to phenol resins, the treatments with the silane coupling agent having an amino group or an epoxy group are preferred.

The treating amount of the above coupling agent or surfactant is preferably 0.1 to 10% by weight based on the weight of the magnetic iron oxide particles to be treated.

The process for producing the spherical magnetic composite particles comprising the magnetic iron oxide particles and the binder resin according to the present invention is as follows.

Examples of the phenol compound used in the present invention include compounds having a phenolic hydroxyl group, e.g., phenol; alkyl phenols such as mcresol, p-cresol, p-tert-butyl phenol and o-propyl phenol; and halogenated phenols obtained by replacing a part or whole of alkyl groups of the above compounds with a chlorine atom or a bromine atom.

The total content of the magnetic iron oxide particles in the spherical magnetic composite particles is preferably 80 to 99% by weight based on the weight of the spherical magnetic composite particles. When the content of the magnetic iron oxide particles is less than 80% by weight, the resin content in the spherical magnetic composite particles tends to be comparatively large, so that the large particles tend to be produced. When the content of the magnetic iron oxide particles is more than 99% by weight, the resin content tends to be insufficient, resulting in poor strength of the obtained particles. The content of the magnetic iron oxide particles in the spherical magnetic composite particles is more preferably 85 to 99% by weight.

Examples of the aldehyde compound used in the present invention include formaldehyde which may be in the form of either formalin or para-aldehyde, acetaldehyde, furfural, glyoxal, acrolein, crotonaldehyde, salicylaldehyde and glutaraldehyde. Among these aldehyde compounds, most preferred is formaldehyde.

The molar ratio of the aldehyde compound to the phenol compound is preferably 1.0 to 4.0. When the molar ratio of the aldehyde compound to the phenol compound is less than 1.0, it may be difficult to produce the aimed particles, or since curing of the resin hardly proceeds, there is a tendency that the obtained particles have a low strength. When the molar ratio of the aldehyde compound to the phenol compound is more than 4.0, there is a tendency that the amount of unreacted aldehyde compound remaining in the aqueous medium after the reaction is increased. The molar ratio of the aldehyde compound to the phenol compound is more preferably 1.2 to 3.0.

As the basic catalyst used in the present invention, there may be mentioned those basic catalysts ordinarily used for production of resol resins. Examples of the basic catalyst include aqueous ammonia, and alkyl amines such as hexamethylenetetramine, dimethyl amine, diethyl amine and polyethylene imine. Among these basic catalysts, especially preferred is aqueous ammonia. The molar ratio of the basic catalyst to the phenol compound is preferably 0.05 to 1.50. When the molar ratio of the basic catalyst to the phenol compound is less than 0.05, curing of the resin tends to hardly proceed to a sufficient extent, so that it may be difficult to suitably granulate the particles. When the molar ratio of the basic catalyst to the phenol compound is more than 1.50, the structure of the phenol resin tends to be adversely affected, resulting in deteriorated granulation of the particles, so that it may be difficult to obtain particles having a large particle diameter.

In the present invention, the reaction may be carried out in the aqueous medium. The concentration of solid components in the aqueous medium is preferably controlled to 30 to 95% by weight and more preferably 60 to 90% by weight.

The reaction solution to which the basic catalyst is added is heated to the temperature range of 60 to 90° C., and reacted at that temperature for 30 to 300 min, preferably 60 to 240 min, to subject the resulting phenol resin to polycondensation reaction for curing thereof.

In the above reaction, in order to obtain spherical magnetic composite particles having a high sphericity, the reaction temperature is preferably gradually increased. The temperature rise rate is preferably 0.5 to 1.5° C./min and more preferably 0.8 to 1.2° C./min.

Also, in the above reaction, in order to well control the particle size of the obtained particles, the stirring speed of the reaction solution is suitably adjusted. The stirring speed is preferably 100 to 1000 rpm.

After completion of curing the resin, the reaction product is cooled to a temperature of not more than 40° C., thereby obtaining a water dispersion of the spherical magnetic composite particles in which the magnetic iron oxide particles are well dispersed in the binder resin and exposed to the surface of the respective particles.

The thus obtained water dispersion of the spherical magnetic composite particles is subjected to filtration, centrifugal separation, etc., by ordinary methods to separate the dispersion into solids and liquid, and then the obtained solids are washed and then dried, thereby obtaining the aimed spherical magnetic composite particles.

The coating resin used in the present invention is not particularly limited. Examples of the suitable coating resin include polyolefin-based resins such as polyethylene and polypropylene; polystyrene; acrylic resins; polyacrylonitrile; polyvinyl-based or polyvinylidene-based resins such as polyvinyl acetate, polyvinyl alcohol, polyvinyl butyral, polyvinyl chloride, polyvinyl carbazole, polyvinyl ether and polyvinyl ketone; vinyl chloride/vinyl acetate copolymers and styrene/acrylic acid copolymers; straight silicone-based resins having an organosiloxane bond and modified products thereof; fluorine-based resins such as polytetrafluoroethylene, polyvinyl fluoride, polyvinylidene fluoride and polychlorotrifluoroethylene; polyesters; polyurethanes; polycarbonates; amino-based resins such as urea/formaldehyde resins; epoxy-based resins; polyamide resins; polyimide resins; polyamide imide resins; fluorine-containing polyamide resins; fluorine-containing polyimide resins; and fluorine-containing polyamide imide resins.

The coating amount of the resin on the magnetic carrier of the present invention is preferably 0.1 to 5.0% by weight based on the weight of the spherical magnetic composite particles. When the coating amount of the resin is less than 0.1% by weight, it may be difficult to sufficiently coat the particles with the resin, resulting in unevenness of the obtained resin coating layer. When the coating amount of the resin is more than 5.0% by weight, although the resin coating layer can adhere onto the surface of the respective composite particles, the thus produced composite particles tend to be agglomerated together, so that it may be difficult to well control the particle size of the composite particles. The coating amount of the resin on the magnetic carrier is more preferably 0.5 to 3.0% by weight.

In the present invention, the resin coating layer may also comprise fine particles. Examples of the suitable fine particles include those fine particles capable of imparting a negative charge to a toner such as fine particles of quaternary ammonium salt-based compounds, triphenylmethane-based compounds, imidazole-based compounds, nigrosine-based dyes, polyamine resins, etc., and those fine particles capable of imparting a positive charge to a toner such as fine particles of dyes comprising metals such as Cr and Co, salicylic acid metal salt compounds, alkyl salicylic acid metal salt compounds, etc. These fine particles may be used singly or in combination of any two or more thereof.

Also, in the present invention, the resin coating layer may also comprise conductive fine particles. It is advantageous to incorporate the conductive fine particles into the resin, because the resulting magnetic carrier can be readily controlled in electric resistance thereof. As the conductive fine particles, there may be used conventionally known fine particles. Examples of the conductive fine particles include fine particles of carbon blacks such as acetylene black, channel black, furnace black and koechen black; carbides of metals such as Si and Ti; nitrides of metals such as B and Ti; and borates of metals such as Mo and Cr. These conductive fine particles may be used singly or in combination of any two or more thereof. Among these conductive fine particles, preferred are fine particles of carbon blacks.

When coating the surface of the respective spherical magnetic composite particles with the resin, there may be used various known methods such as the method of blowing the resin onto the spherical magnetic composite particles using a spray dryer; the method of dry-mixing the spherical magnetic composite particles with the resin using a Henschel mixer, a high-speed mixer, etc.; and the method of immersing the spherical magnetic composite particles in a solvent comprising the resin.

Next, the two-component developer of the present invention is described.

As the toner used in combination with the carrier of the present invention, there may be mentioned known toners. More specifically, there may be used those toners comprising a binder resin and a colorant as main components together with a release agent, a magnetic material, a fluidizing agent, etc., which may be added to the main components, if required. Also, the toners may be produced by conventionally known methods.

The important point of the present invention resides in that the magnetic iron oxide particles having an adequate electric resistance value and a less voltage dependency of the electric resistance are bonded to the phenol-based resin as a binder, thereby producing a magnetic carrier for electrophotographic developer which has a sufficient electric resistance value and a less voltage dependency of the electric resistance value.

As a result, it is considered by the present inventors that when using the magnetic carrier for electrophotographic developer according to the present invention, images having an excellent gradation can be obtained.

The magnetic carrier for electrophotographic developer according to the present invention has an adequate electric resistance value and a less voltage dependency of the electric resistance value and, therefore, is suitable as a magnetic carrier for electrophotography.

EXAMPLES

The present invention is described in more detail by the following typical Examples and Comparative Examples in which Examples 1-1 to 1-5 and Comparative Examples 1-1 to 1-8 relate to the black magnetic iron oxide particles of Invention 1, and Examples 2-1 to 2-10 and Comparative Examples 2-1 to 2-16 relate to the magnetic carrier for electrophotographic developer of Invention 5.

<Measuring Methods>

The average particle diameter of the black magnetic iron oxide particles is the value determined from Fere diameters of 300 particles observed on a transmission electron micrograph thereof.

The shape of the black magnetic iron oxide particles was determined from micrographs obtained by observing particles using a transmission electron microscope and a scanning electron microscope "S-4800" manufactured by Hitachi High-Technologies Corp.

The water adsorption Ma0.9 of the black magnetic iron oxide particles was expressed by the value of water adsorption measured at 25° C. under a relative pressure of 0.9 using a high-precision water vapor adsorption measuring apparatus "BELSORP-aqua3" manufactured by Nippon Bel Co., Ltd.

The BET specific surface area value of the black magnetic iron oxide particles was measured by a BET method using "Mono Sorb MS-II" manufactured by Yuasa Ionics Co., Ltd.

The amounts of Al and metal elements contained in the black magnetic iron oxide particles were measured by a "Fluorescent X-ray Analyzer RIX-2100" manufactured by Rigaku Denki Kogyo Co., Ltd., and expressed by the values calculated in terms of the respective elements on the basis of the black magnetic iron oxide particles.

The electric resistance value of the black magnetic iron oxide particles was determined as follows. That is, 2.0 g of sample particles to be measured were weighed, and charged into a measuring container. Under the condition of applying a pressure of 14 MPa, a constant voltage of 100 V or 10 V was applied to the particles to measure electric resistance values thereof using a "High Resistance Meter 4339B" manufactured by Hewlett Packard Inc., and calculate a volume resistivity value from the thus measured electric resistance values as well as an area and a thickness of an electrode used.

The grain size value of the black magnetic iron oxide particles was determined according to JIS K 5101 as follows. That is, 0.5 mL of a castor oil was added to 0.5 g of a sample. The resulting mixture was stirred by 50 revolutions using a Hoover Muller, and the stirring procedure was repeated twice to measure a size of grains therein using a grind gauge.

The average particle diameter of the spherical magnetic composite particles was expressed by the volume-based average particle diameter measured using a laser diffraction particle size distribution meter "LA500" manufactured by Horiba Seisakusho Co., Ltd.

The shape of the spherical magnetic composite particles was determined from a micrograph obtained by observing particles using a scanning electron microscope "S-4800" manufactured by Hitachi High-Technologies Corp.

The saturation magnetization was expressed by the value measured using a vibration sample-type magnetometer "SM-3S-15" manufactured by Toei Kogyo Co., Ltd., by applying an external magnetic field of 795.8 kA/m (10 kOe) thereto.

The true specific gravity was measured using a multi-volume density meter "1305 Type" manufactured by Shimadzu Seisakusho Corp.

The electric resistance value (volume resistivity value) of the spherical magnetic composite particles was expressed by the value measured as to 1.0 g of sample particles using a "High Resistance Meter 4339B" manufactured by Yokogawa Hewlett Packard Co., Ltd.

The evaluation of obtained images was performed as follows. That is, using a modified device of "LP8000C" manufactured by Epson Corp., whose original carrier was replaced with the carrier of the present invention, the printing test was carried out while varying a bias voltage applied.

The gradation of printed image was evaluated by observing the image by naked eyes, according to Gray Scale (0 to 19 Gradation test chart) produced by KODAK Inc.

A: 15 Gradation or more
B: 12 to 14 Gradation
C: 8 to 11 Gradation
D: 7 Gradation or less Examples Concerning Black Magnetic Iron Oxide Articles of Invention 1

Examples 1-1

Iron Oxide 1

<Method for Producing Iron Oxide Particles>

One hundred liters of a slurry comprising 90 g/L of $Fe_3O_4$ iron oxide core particles A having a spherical shape and an average particle diameter of 0.24 μm were mixed with a sodium hydroxide solution at 90° C. to adjust a pH of the slurry to 8.5. To the resulting slurry, 3 L of a 1.9 mol/L aluminum sulfate aqueous solution and a sodium hydroxide aqueous solution were added at the same time over 190 min while adjusting a pH of the slurry to 8.5±0.2. Next, the resulting slurry was aged for 60 min, and then dilute sulfuric acid was added thereto to adjust a pH of the slurry to 7.0. Thereafter, the obtained slurry was successively subjected to filtration, water-washing and then drying, thereby obtaining iron oxide particles surface-treated with Al.

The thus obtained iron oxide particles had a BET specific surface area of 7.4 $m^2/g$, an Al content of 1.68%, an electric resistance value at an applied voltage of 100 V of $7.1\times10^9$ Ω·m, a saturation magnetization of 83.8 $Am^2/kg$ and a water adsorption Ma0.9 of 7.2 mg/g.

Example 1-5

Iron Oxide 5

The same procedure as defined in Example 1-1 was conducted except that a mixture of an aluminum sulfate aqueous solution and a magnesium sulfate aqueous solution was added, thereby obtaining black magnetic iron oxide particles.

Example 1-6

Iron Oxide 6

The same procedure as defined in Example 1-1 was conducted except that a titanyl sulfate aqueous solution was added in place of the aluminum sulfate aqueous solution, thereby obtaining black magnetic iron oxide particles.

Example 1-7

Iron Oxide 7

The same procedure as defined in Example 1-1 was conducted except that a sodium silicate aqueous solution was added in place of the aluminum sulfate aqueous solution, thereby obtaining black magnetic iron oxide particles.

Comparative Example 1-1

Iron Oxide 8

<Method for Producing Iron Oxide Particles>

One hundred liters of a slurry comprising 90 g/L of $Fe_3O_4$ iron oxide core particles A having a spherical shape and an average particle diameter of 0.24 μm were mixed with a sodium hydroxide solution at 90° C. to adjust a pH of the slurry to 11. To the resulting slurry, 3.5 L of a 1.9 mol/L aluminum sulfate aqueous solution was added and stirred, and then 0.3 L of a 1.1 mol/L magnesium sulfate solution was added. The resulting slurry was mixed for 20 min, and after once adjusting the pH thereof to 9.0, further mixed for 5 min. Then, dilute sulfuric acid was added to the resulting slurry to adjust a pH of the slurry to 7.0. Thereafter, the obtained slurry was successively subjected to filtration, water-washing and then drying, thereby obtaining black magnetic iron oxide particles surface-treated with Al and Mg.

Comparative Example 7

Iron Oxide 14

Eighty liters of a slurry comprising 70 g/L of $Fe_3O_4$ iron oxide core particles A having a spherical shape and an average particle diameter of 0.24 μm were mixed with 6.9 L of a 0.5 mol/L aluminum sulfate aqueous solution, 4.6 L of a 1.5 mol/L ferrous sulfate aqueous solution and a sodium hydroxide solution at 80° C. to adjust a pH of the slurry to 9.0. Then, air was passed through the resulting slurry at a rate of 80 L/min to terminate the oxidation reaction. Thereafter, the obtained slurry was successively subjected to filtration, water-washing and then drying, thereby obtaining black magnetic iron oxide particles having a composite iron oxide layer on the surface thereof.

Comparative Example 1-8

Iron Oxide 15

One hundred liters of a slurry comprising 70 g/L of $Fe_3O_4$ iron oxide core particles C having a hexahedral shape and an average particle diameter of 0.23 μm were mixed with 4.1 L of a 0.5 mol/L aluminum sulfate aqueous solution at 80° C. to adjust a pH of the slurry to 8. Thereafter, the obtained slurry was stirred and mixed for 3 hr, and then successively subjected to filtration, water-washing and drying, thereby obtaining black magnetic iron oxide particles surface-treated with Al. Two kilograms of the thus obtained surface-treated black magnetic iron oxide particles were charged into a Simpson mix muller "SAND MILL MPUV-2" manufactured by Matsumoto Chuzo Tekkosho Co., Ltd., and treated therein at a linear load of 160 kg/cm for 30 min. After completion of the treatment, the temperature of the obtained particles was measured. As a result, it was confirmed that the temperature of the particles was 105° C.

Comparative Example 1-9

Iron Oxide 16

Twenty liters of a ferrous sulfate aqueous solution comprising 1.6 mol/L of $Fe^{2+}$, 20.8 L of a 1.5 mol/L sodium hydroxide solution and 4 L of a 0.4 mol/L sodium carbonate solution were subjected to oxidation reaction at 90° C. while passing air therethrough at a rate of 80 L/min until completing the oxidation reaction. The resulting slurry was mixed with 1.2 L of a 0.5 mol/L aluminum sulfate aqueous solution, 0.75 L of a 1.6 mol/L ferrous sulfate aqueous solution and a sodium hydroxide aqueous solution to adjust a pH of the slurry to 9.0. Thereafter, air was passed again through the slurry at a rate of 80 L/min, thereby terminating the oxidation reaction. The obtained slurry was successively subjected to filtration, water-washing and then drying, thereby obtaining magnetic iron oxide particles having a tetradecahedron structure.

Examples 1-2 to 1-4

Iron Oxides 2 to 4

Comparative Examples 1-2 to 1-6

Iron Oxides 9 to 13

The same procedure as defined in Example 1-1 was conducted except that the conditions for production of the black magnetic iron oxide particles were changed variously, thereby obtaining black magnetic iron oxide particles.

Various properties of the iron oxide core particles are shown in Table 1, and production conditions of the iron oxide particles are shown in Table 2. Further, various properties of the obtained black magnetic iron oxide particles are shown in Table 3.

TABLE 1

| | Properties of iron oxide core particles | | | |
|---|---|---|---|---|
| | Kind | Shape | Average particle diameter (μm) | BET specific surface area ($m^2/g$) |
| Iron oxide core particles A | $Fe_3O_4$ | Spherical | 0.24 | 6.9 |
| Iron oxide core particles B | $Fe_3O_4$ | Spherical | 0.10 | 13.2 |
| Iron oxide core particles C | $Fe_3O_4$ | Hexahedral | 0.23 | 6.3 |
| Iron oxide core particles D | $Fe_3O_4$ | Octahedral | 0.30 | 5.0 |

TABLE 2

| Examples and Comparative Examples | Iron oxide core particles Kind | Surface treating conditions of iron oxide | | |
|---|---|---|---|---|
| | | Concentration of water suspension (g/L) | Amount of water suspension (L) | Treating temperature (° C.) |
| Example 1-1 | A | 90 | 100 | 90 |
| Example 1-2 | B | 90 | 100 | 75 |
| Example 1-3 | C | 70 | 100 | 80 |
| Example 1-4 | D | 85 | 100 | 85 |
| Example 1-5 | A | 85 | 100 | 85 |
| Example 1-6 | A | 90 | 100 | 90 |
| Example 1-7 | A | 90 | 100 | 90 |
| Comparative Example 1-2 | A | 80 | 100 | 90 |
| Comparative Example 1-3 | A | 80 | 100 | 90 |
| Comparative Example 1-4 | A | 80 | 100 | 90 |
| Comparative Example 1-5 | A | 80 | 100 | 90 |
| Comparative Example 1-6 | A | 80 | 100 | 90 |

| Examples and Comparative Examples | Surface treating conditions of iron oxide | | | |
|---|---|---|---|---|
| | Kind of metal element component | Concentration of metal element component (g/L) | Amount of metal element component (L) | Surface treatment pH |
| Example 1-1 | Aluminum sulfate | 1.9 | 3 | 8.5 ± 0.2 |
| Example 1-2 | Aluminum sulfate | 0.3 | 14.7 | 8.5 ± 0.2 |
| Example 1-3 | Aluminum sulfate | 0.5 | 4.5 | 8.5 ± 0.2 |
| Example 1-4 | Aluminum sulfate | 1.9 | 5.1 | 8.5 ± 0.2 |
| Example 1-5 | Aluminum sulfate | 1.9 | 3.2 | 8.5 ± 0.2 |
| Example 1-6 | Titanyl sulfate | 0.5 | 4.5 | 8.5 ± 0.2 |
| Example 1-7 | Sodium silicate | 0.5 | 7.0 | 7.0 ± 0.2 |
| Comparative Example 1-2 | Aluminum sulfate | 0.5 | 7.0 | 9.5 ± 0.2 |
| Comparative Example 1-3 | Aluminum sulfate | 0.5 | 7.0 | 6.5 ± 0.2 |
| Comparative Example 1-4 | Aluminum sulfate | 0.5 | 32.4 | 8.5 ± 0.2 |
| Comparative Example 1-5 | Aluminum sulfate | 0.5 | 1.4 | 8.5 ± 0.2 |
| Comparative Example 1-6 | Aluminum sulfate | 1.9 | 4 | 8.5 ± 0.2 |

| Examples and Comparative Examples | Surface treating conditions of iron oxide | | | |
|---|---|---|---|---|
| | Time of addition of metal components (min) | Velocity of addition of metal components (wt %/min) | Aging time (min) | Neutralization pH |
| Example 1-1 | 190 | 0.009 | 60 | 7.0 |
| Example 1-2 | 175 | 0.007 | 60 | 7.0 |
| Example 1-3 | 195 | 0.004 | 60 | 7 |
| Example 1-4 | 355 | 0.008 | 60 | 7 |
| Example 1-5 | 215 | 0.009 | 60 | 7 |
| Example 1-6 | 190 | 0.006 | 60 | 7 |
| Example 1-7 | 210 | 0.005 | 60 | 7 |
| Comparative Example 1-2 | 150 | 0.008 | 60 | 7 |
| Comparative Example 1-3 | 125 | 0.009 | 60 | 7 |
| Comparative Example 1-4 | 720 | 0.007 | 60 | 7 |
| Comparative | 30 | 0.008 | 60 | 7 |

TABLE 2-continued

| | | | | |
|---|---|---|---|---|
| Example 1-5 | | | | |
| Comparative Example 1-6 | 25 | 0.097 | 60 | 7 |

| Examples and Comparative Examples | Surface treating conditions of iron oxide | | |
|---|---|---|---|
| | Kind of other element | Concentration of other element component (mol/L) | Amount of other element component (L) |
| Example 1-1 | — | — | — |
| Example 1-2 | — | — | — |
| Example 1-3 | — | — | — |
| Example 1-4 | — | — | — |
| Example 1-5 | Magnesium sulfate | 1.1 | 0.7 |
| Example 1-6 | — | — | — |
| Example 1-7 | — | — | — |
| Comparative Example 1-2 | — | — | — |
| Comparative Example 1-3 | — | — | — |
| Comparative Example 1-4 | — | — | — |
| Comparative Example 1-5 | — | — | — |
| Comparative Example 1-6 | — | — | — |

TABLE 3

| Examples and Comparative Examples | Average particle diameter (μm) | BET specific surface area ($m^2/g$) | Amount of metal element (wt %) | Amount of Mg (wt %) |
|---|---|---|---|---|
| Example 1-1 | 0.24 | 7.4 | 1.68 | — |
| Example 1-2 | 0.10 | 13.5 | 1.26 | — |
| Example 1-3 | 0.23 | 6.5 | 0.86 | — |
| Example 1-4 | 0.30 | 5.7 | 2.79 | — |
| Example 1-5 | 0.24 | 7.7 | 1.88 | 0.19 |
| Example 1-6 | 0.24 | 7.7 | 1.21 | — |
| Example 1-7 | 0.24 | 7.6 | 1.08 | — |
| Comparative Example 1-1 | 0.24 | 7.2 | 1.88 | 0.09 |
| Comparative Example 1-2 | 0.24 | 10.5 | 1.21 | — |
| Comparative Example 1-3 | 0.24 | 9.9 | 1.22 | — |
| Comparative Example 1-4 | 0.24 | 9.2 | 4.93 | — |
| Comparative Example 1-5 | 0.24 | 7.0 | 0.24 | — |
| Comparative Example 1-6 | 0.24 | 10.4 | 2.41 | — |
| Comparative Example 1-7 | 0.24 | 9.5 | 1.50 | — |
| Comparative Example 1-8 | 0.23 | 8.7 | 0.78 | — |
| Comparative Example 1-9 | 0.35 | 6.0 | 0.62 | — |

| Examples and Comparative Examples | Electric resistance value at applied voltage of 10 V (·cm) | Electric resistance value at applied voltage of 100 V (·cm) | Saturation magnetization ($Am^2/kg$) |
|---|---|---|---|
| Example 1-1 | $8.2 \times 10^9$ | $7.1 \times 10^9$ | 83.8 |
| Example 1-2 | $7.0 \times 10^8$ | $5.9 \times 10^8$ | 81.2 |
| Example 1-3 | $3.3 \times 10^9$ | $2.7 \times 10^9$ | 83.5 |
| Example 1-4 | $4.1 \times 10^9$ | $3.5 \times 10^9$ | 80.2 |

TABLE 3-continued

| | | | |
|---|---|---|---|
| Example 1-5 | $7.2 \times 10^9$ | $6.5 \times 10^9$ | 82.9 |
| Example 1-6 | $6.0 \times 10^8$ | $5.5 \times 10^8$ | 83.5 |
| Example 1-7 | $7.9 \times 10^8$ | $7.0 \times 10^8$ | 83.7 |
| Comparative Example 1-1 | $8.3 \times 10^7$ | * | 83.1 |
| Comparative Example 1-2 | $5.7 \times 10^7$ | $2.5 \times 10^7$ | 84.1 |
| Comparative Example 1-3 | $2.7 \times 10^7$ | * | 83.2 |
| Comparative Example 1-4 | $7.4 \times 10^{10}$ | $1.9 \times 10^{10}$ | 76.0 |
| Comparative Example 1-5 | $3.2 \times 10^6$ | * | 86.5 |
| Comparative Example 1-6 | $3.4 \times 10^8$ | $7.6 \times 10^7$ | 81.2 |
| Comparative Example 1-7 | $1.1 \times 10^7$ | * | 79.1 |
| Comparative Example 1-8 | $1.3 \times 10^8$ | $5.0 \times 10^7$ | 80.3 |
| Comparative Example 1-9 | $8.0 \times 10^7$ | * | 82.6 |

| Examples and Comparative Examples | RM100/RM10 | Water adsorption Ma0.9 (mg/g) | Grain size (μm) |
|---|---|---|---|
| Example 1-1 | 0.87 | 7.2 | 50↓ |
| Example 1-2 | 0.84 | 11.2 | 50↓ |
| Example 1-3 | 0.82 | 6.5 | 50↓ |
| Example 1-4 | 0.85 | 8.9 | 50↓ |
| Example 1-5 | 0.9 | 7.7 | 50↓ |
| Example 1-6 | 0.92 | 8.5 | 50↓ |
| Example 1-7 | 0.89 | 9.0 | 50↓ |
| Comparative Example 1-1 | * | 9.5 | 50↓ |
| Comparative Example 1-2 | 0.44 | 17.8 | 50↓ |
| Comparative Example 1-3 | * | 16.3 | 50↓ |
| Comparative Example 1-4 | 0.26 | 23.4 | 50↓ |
| Comparative Example 1-5 | * | 6.9 | 50↓ |
| Comparative Example 1-6 | 0.22 | 17.1 | 50↓ |
| Comparative Example 1-7 | * | 8.3 | 50↓ |
| Comparative Example 1-8 | 0.38 | 8.1 | 100↑ |
| Comparative Example 1-9 | * | 8.7 | 50↓ |

Note
*: Unmeasurable because the electric resistance value was too low.

As shown in Table 3, the electric resistance values at an applied voltage of 100 v of the black magnetic iron oxide particles obtained in Comparative Examples 1-1, 1-3, 1-5 and were very low, and, therefore, unmeasurable.

The black magnetic iron oxide particles obtained according to the present invention which exhibited a high electric resistance value in a high voltage range, a low moisture absorption and an excellent dispersibility can be suitably used as a pigment in various applications. The material can be especially suitably applied to a toner, because images obtained by the toner exhibit a high image density even under high-temperature and high-humidity conditions.

Examples Concerning Agnetic Carrier for Electrophotographic Developer of Invention 5:

<Production of Spherical Magnetic Composite Particles: Lipophilic Treatment of Magnetic Iron Oxide Particles>

One thousand grams of iron oxide 1 were charged into a flask and intimately stirred, and then 7.0 g of an epoxy group-containing silane-based coupling agent (tradename "KBM-403" produced by Shin-Etsu Chemical Co., Ltd.) were added to the flask. The contents of the flask were heated to about 100° C. and intimately mixed with stirring for 30 min, thereby obtaining spherical magnetite particles coated with the coupling agent.

Example 2-1

Example Concerning Production of Spherical Magnetic Composite Particles

| | |
|---|---|
| Phenol resin | 10 parts by weight |
| 37% Formalin | 15 parts by weight |
| Magnetic iron oxide particles of iron oxide 1 subjected to lipophilic treatment | 100 parts by weight |
| 25% Aqueous ammonia | 3 parts by weight |
| Water | 13 parts by weight |

The above materials were charged into a flask and heated to 85° C. over 60 min while stirring at 250 rpm, and then reacted and cured at that temperature for 120 min, thereby producing composite particles comprising the magnetic iron oxide particles and the cured phenol resin.

Next, the contents of the flask were cooled to 30° C., and then a supernatant liquid was removed therefrom. Further, a precipitate as a lower layer was washed with water and air-dried. Then, the resulting dried product was further dried at a temperature of 150 to 200° C. under reduced pressure (not more than 5 mmHg), thereby obtaining spherical magnetic composite particles for magnetic core particles.

The thus obtained spherical magnetic composite particles had an average particle diameter of 32 μm, specific gravity of 3.72 g/cm$^3$, a saturation magnetization value of 74.1 Am$^2$/kg, an electric resistance value R100 at an applied voltage of 100 V of $1.3\times10^{11}$ Ω·m, an electric resistance value R300 at an applied voltage of 300 V of $4.9\times10^{10}$ Ω·m, a ratio of R300/R100 of 0.38, and a water adsorption Ma0.9 of 5.3 mg/g.

Next, the contents of the flask were cooled to 30° C., and then a supernatant liquid was removed therefrom. Further, a precipitate as a lower layer was washed with water and air-dried. Then, the resulting dried product was further dried at a temperature of 150 to 200° C. under reduced pressure (not more than 5 mmHg), thereby obtaining a magnetic carrier comprising the spherical magnetic composite particles.

Examples 2-2 to 2-7 and Comparative Examples 2-1 to 2-8

The same procedure as defined in Example 2-1 was conducted except that the conditions for production of the magnetic carrier were changed variously, thereby obtaining magnetic carriers.

The production conditions of the obtained magnetic carriers comprising the spherical magnetic composite particles are shown in Table 4, and various properties of the magnetic carriers are shown in Table 5.

As recognized from Examples shown in Table 5, the spherical magnetic composite particles according to the present invention exhibited a sufficient electric resistance value and a less voltage dependency of the electric resistance and were, therefore, suitable as a magnetic carrier for electrophotographic developer.

Examples 2-6

Production of Magnetic Carrier Coated with Resin

Under a nitrogen gas flow, a Henschel mixer was charged with 1 kg of the spherical magnetic composite particles obtained in Example 1-1 and 9 g of a silicone-based resin (tradename "KR251" produced by Shin-Etsu Chemical Co., Ltd.) as a solid content, and the contents of the mixer were heated to 200° C. while stirring, and stirred at that temperature for 1 hr, thereby forming a resin coating layer comprising the silicone-based resin on the surface of the respective particles.

The thus obtained magnetic carrier comprising the spherical magnetic composite particles having the resin coating layer thereon had an average particle diameter of 32 μm, a specific gravity of 3.50 g/cm$^3$, a saturation magnetization value of 73.4 Am$^2$/kg, an electric resistance value R100 at an applied voltage of 100 V of $4.7\times10^{12}$ Ω·m, and an electric resistance value R300 at an applied voltage of 300 V of $3.6\times10^{12}$ Ω·m.

The production conditions and various properties of the resin-coated spherical magnetic composite particles are shown in Table 6, and the evaluation results of printing durability of the magnetic carriers are shown in Table 7.

Examples 2-9 to 2-12 and Comparative Examples 2-9 to 2-16

The same procedure as defined in Example 2-8 was conducted except that kinds of the spherical magnetic composite particles, kinds of the resins, and coating amounts of the resins were changed variously, thereby obtaining magnetic carriers for electrophotographic developer comprising the spherical magnetic composite particles and a surface coating layer formed on the surface of the respective composite particles.

The production conditions and various properties of the resin-coated spherical magnetic composite particles are shown in Table 6, and the evaluation results of printing durability of the magnetic carriers are shown in Table 7.

TABLE 4

| Examples and Comparative Examples | Iron oxide particles | | Lipophilic treatment agent | |
|---|---|---|---|---|
| | Kind | Amount (g) | Kind | Amount (g) |
| Example 2-1 | Iron oxide 1 | 1000 | KBM-403 | 7 |
| Example 2-2 | Iron oxide 2 | 1000 | KBM-403 | 13 |
| Example 2-3 | Iron oxide 3 | 1000 | KBM-403 | 7 |
| Example 2-4 | Iron oxide 4 | 1000 | KBM-403 | 6 |
| Example 2-5 | Iron oxide 5 | 1000 | KBM-403 | 8 |
| Example 2-6 | Iron oxide 6 | 1000 | KBM-403 | 7 |
| Example 2-7 | Iron oxide 7 | 1000 | KBM-403 | 7 |
| Comparative Example 2-1 | Iron oxide 8 | 1000 | KBM-403 | 7 |
| Comparative Example 2-2 | Iron oxide 9 | 1000 | KBM-403 | 11 |
| Comparative Example 2-3 | Iron oxide 10 | 1000 | KBM-403 | 10 |
| Comparative Example 2-4 | Iron oxide 11 | 1000 | KBM-403 | 9 |
| Comparative Example 2-5 | Iron oxide 12 | 1000 | KBM-403 | 7 |
| Comparative Example 2-6 | Iron oxide 13 | 1000 | KBM-403 | 10 |
| Comparative | Iron oxide 14 | 1000 | KBM-403 | 10 |

TABLE 4-continued

| | | | | |
|---|---|---|---|---|
| Example 2-7 | | | | |
| Comparative Example 2-8 | Iron oxide 16 | 1000 | KBM-403 | 7 |

| Examples and Comparative Examples | Binder resin | Aldehyde compound | |
|---|---|---|---|
| | Phenol (wt part) | Kind | Amount (wt part) |
| Example 2-1 | 10 | Formalin | 15 |
| Example 2-2 | 12 | Formalin | 18 |
| Example 2-3 | 11 | Formalin | 17 |
| Example 2-4 | 10 | Formalin | 15 |
| Example 2-5 | 10 | Formalin | 15 |
| Example 2-6 | 10 | Formalin | 15 |
| Example 2-7 | 11 | Formalin | 18 |
| Comparative Example 2-1 | 10 | Formalin | 15 |
| Comparative Example 2-2 | 12 | Formalin | 18 |
| Comparative Example 2-3 | 10 | Formalin | 15 |
| Comparative Example 2-4 | 12 | Formalin | 18 |
| Comparative Example 2-5 | 10 | Formalin | 15 |
| Comparative Example 2-6 | 11 | Formalin | 17 |
| Comparative Example 2-7 | 10 | Formalin | 15 |
| Comparative Example 2-8 | 10 | Formalin | 15 |

| Examples and Comparative Examples | Basic catalyst | | Water |
|---|---|---|---|
| | Kind | Amount | Amount |
| Example 2-1 | Aqueous ammonia | 3 | 13 |
| Example 2-2 | Aqueous ammonia | 4 | 10 |
| Example 2-3 | Aqueous ammonia | 3 | 10 |
| Example 2-4 | Aqueous ammonia | 3 | 12 |
| Example 2-5 | Aqueous ammonia | 3 | 15 |
| Example 2-6 | Aqueous ammonia | 3 | 12 |
| Example 2-7 | Aqueous ammonia | 4 | 13 |
| Comparative Example 2-1 | Aqueous ammonia | 3 | 14 |
| Comparative Example 2-2 | Aqueous ammonia | 4 | 15 |
| Comparative Example 2-3 | Aqueous ammonia | 3 | 13 |
| Comparative Example 2-4 | Aqueous ammonia | 4 | 13 |
| Comparative Example 2-5 | Aqueous ammonia | 3 | 14 |
| Comparative Example 2-6 | Aqueous ammonia | 3 | 10 |
| Comparative Example 2-7 | Aqueous ammonia | 3 | 13 |
| Comparative Example 2-8 | Aqueous ammonia | 3 | 14 |

TABLE 5

| Examples and Comparative Examples | Properties of composite particles | | |
|---|---|---|---|
| | Average particle diameter (μm) | Specific gravity (g/cm$^3$) | Saturation magnetization (Am$^2$/kg) |
| Example 2-1 | 32 | 3.72 | 74.1 |
| Example 2-2 | 37 | 3.68 | 72.8 |
| Example 2-3 | 38 | 3.65 | 75.1 |
| Example 2-4 | 41 | 3.78 | 71.3 |
| Example 2-5 | 27 | 3.58 | 72.8 |
| Example 2-6 | 33 | 3.70 | 73.0 |
| Example 2-7 | 37 | 3.65 | 72.1 |
| Comparative Example 2-1 | 38 | 3.67 | 73.7 |
| Comparative Example 2-2 | 34 | 3.63 | 73.3 |
| Comparative Example 2-3 | 33 | 3.71 | 73.1 |
| Comparative Example 2-4 | 37 | 3.69 | 66.1 |
| Comparative Example 2-5 | 41 | 3.77 | 75.4 |
| Comparative Example 2-6 | 43 | 3.69 | 71.4 |
| Comparative Example 2-7 | 35 | 3.70 | 70.6 |
| Comparative Example 2-8 | 33 | 3.73 | 72.9 |

| Examples and Comparative Examples | Properties of composite particles | | | |
|---|---|---|---|---|
| | Electric resistance value $R_{100}$ at applied voltage of 100 V (·cm) | Electric resistance value $R_{300}$ at applied voltage of 300 V (·cm) | $R_{300}/R_{100}$ (·cm) | Water adsorption Ma0.9 (mg/g) |
| Example 2-1 | 1.3E+11 | 4.9E+10 | 0.38 | 5.3 |
| Example 2-2 | 2.8E+09 | 1.2E+09 | 0.43 | 8.1 |
| Example 2-3 | 5.5E+10 | 1.8E+10 | 0.33 | 5.1 |
| Example 2-4 | 8.8E+10 | 3.1E+10 | 0.35 | 7.9 |
| Example 2-5 | 1.2E+11 | 4.7E+10 | 0.39 | 6.5 |
| Example 2-6 | 3.4E+08 | 1.3E+09 | 0.38 | 7.0 |
| Example 2-7 | 2.7E+08 | 1.2E+09 | 0.44 | 6.9 |
| Comparative Example 2-1 | 3.5E+08 | * | — | 9.0 |
| Comparative Example 2-2 | 1.2E+08 | * | — | 12.3 |
| Comparative Example 2-3 | 1.7E+08 | * | — | 12.9 |
| Comparative Example 2-4 | 1.3E+13 | 3.5E+11 | 0.03 | 15.1 |
| Comparative Example 2-5 | 2.9E+08 | * | — | 7.0 |
| Comparative Example 2-6 | 3.1E+08 | * | — | 13.2 |
| Comparative Example 2-7 | 8.0E+07 | * | — | 6.4 |
| Comparative Example 2-8 | 9.5E+07 | * | — | 6.3 |

Note
*: Unmeasurable because the electric resistance value was too low.

TABLE 6

| Examples and Comparative Examples | Core particles Kind | Coating resin | |
|---|---|---|---|
| | | Kind | Amount (part) |
| Example 2-6 | Example 2-1 | Silicone-base resin | 0.9 |
| Example 2-7 | Example 2-2 | Silicone-base resin | 1 |

TABLE 6-continued

| | | | |
|---|---|---|---|
| Example 2-8 | Example 2-3 | Silicone-base resin | 1.2 |
| Example 2-9 | Example 2-4 | Styrene/acrylic resin | 1 |
| Example 2-10 | Example 2-5 | Silicone-base resin | 1 |
| Example 2-11 | Example 2-6 | Silicone-base resin | 1 |
| Example 2-12 | Example 2-7 | Silicone-base resin | 1 |
| Comparative Example 2-9 | Comparative Example 2-1 | Silicone-base resin | 1 |
| Comparative Example 2-10 | Comparative Example 2-2 | Silicone-base resin | 1 |
| Comparative Example 2-11 | Comparative Example 2-3 | Silicone-base resin | 1 |
| Comparative Example 2-12 | Comparative Example 2-4 | Silicone-base resin | 1 |
| Comparative Example 2-13 | Comparative Example 2-5 | Silicone-base resin | 1 |
| Comparative Example 2-14 | Comparative Example 2-6 | Silicone-base resin | 1 |
| Comparative Example 2-15 | Comparative Example 2-7 | Silicone-base resin | 1 |
| Comparative Example 2-16 | Comparative Example 2-8 | Silicone-base resin | 1 |

| Examples and Comparative Examples | Properties Average particle diameter (μm) | Specific gravity ($g/cm^3$) | Saturation magnetization ($Am^2/kg$) |
|---|---|---|---|
| Example 2-6 | 32 | 3.50 | 73.4 |
| Example 2-7 | 37 | 3.64 | 72.2 |
| Example 2-8 | 38 | 3.60 | 74.3 |
| Example 2-9 | 41 | 3.75 | 70.7 |
| Example 2-10 | 27 | 3.53 | 70.9 |
| Example 2-11 | 33 | 3.51 | 72.5 |
| Example 2-12 | 37 | 3.63 | 71.3 |
| Comparative Example 2-9 | 38 | 3.63 | 72.9 |
| Comparative Example 2-10 | 34 | 3.60 | 72.6 |
| Comparative Example 2-11 | 33 | 3.69 | 72.9 |
| Comparative Example 2-12 | 37 | 3.62 | 65.7 |
| Comparative Example 2-13 | 41 | 3.70 | 74.3 |
| Comparative Example 2-14 | 43 | 3.68 | 70.9 |
| Comparative Example 2-15 | 35 | 3.70 | 69.1 |
| Comparative Example 2-16 | 33 | 3.69 | 70.5 |

| Examples and Comparative Examples | Properties Electric resistance value $R_{100}$ (·cm) | Electric resistance value $R_{300}$ (·cm) | $R_{300}/R_{100}$ | Properties Water adsorption M0.9 (mg/g) |
|---|---|---|---|---|
| Example 2-6 | 4.7E+12 | 3.6E+12 | 0.77 | 5.1 |
| Example 2-7 | 5.3E+13 | 4.1E+13 | 0.77 | 7.7 |
| Example 2-8 | 2.1E+14 | 1.3E+14 | 0.62 | 4.5 |
| Example 2-9 | 4.2E+13 | 3.0E+13 | 0.71 | 7.5 |
| Example 2-10 | 7.8E+13 | 5.3E+13 | 0.68 | 6.3 |
| Example 2-11 | 5.7E+13 | 4.0E+13 | 0.70 | 5.0 |
| Example 2-12 | 5.0E+12 | 3.6E+12 | 0.72 | 6.3 |
| Comparative Example 2-9 | 9.7E+12 | 3.3E+12 | 0.34 | 8.8 |
| Comparative Example 2-10 | 8.5E+12 | 2.7E+12 | 0.32 | 12.0 |
| Comparative Example 2-11 | 9.0E+12 | 2.2E+12 | 0.24 | 12.4 |
| Comparative Example 2-12 | 1.5E+15 | 1.9E+14 | 0.13 | 14.7 |
| Comparative Example 2-13 | 3.3E+13 | 6.7E+12 | 0.20 | 6.6 |
| Comparative Example 2-14 | 4.1E+13 | 7.8E+12 | 0.19 | 12.5 |
| Comparative Example 2-15 | 5.7E+12 | 4.3E+11 | 0.08 | 6.0 |
| Comparative Example 2-16 | 7.3E+12 | 1.1E+12 | 0.15 | 6.1 |

TABLE 7

| Kind of resin-coated carrier | Gradation Initial | 10k | 50k |
|---|---|---|---|
| Example 2-6 | A | A | A |
| Example 2-7 | A | A | B |
| Example 2-8 | A | A | A |
| Example 2-9 | A | A | A |
| Example 2-10 | A | A | A |
| Example 2-11 | A | A | B |
| Example 2-12 | A | A | B |
| Comparative Example 2-9 | B | C | D |
| Comparative Example 2-10 | B | D | D |
| Comparative Example 2-11 | B | D | D |
| Comparative Example 2-12 | D | D | D |
| Comparative Example 2-13 | C | D | D |
| Comparative Example 2-14 | C | D | D |
| Comparative Example 2-15 | D | D | D |
| Comparative Example 2-16 | C | D | D |

As shown in Table 7, the magnetic carriers according to the present invention were excellent in gradation of images even after subjected to 50,000 printing cycles and, therefore, exhibited a less voltage dependency and were capable of maintaining the less voltage dependency for a long period of time. As a result, it was confirmed that the magnetic carrier of the present invention had excellent image characteristics.

Thus, the magnetic carrier for electrophotographic developer according to the present invention comprises the spherical magnetic composite particles comprising the magnetic iron oxide particles having a high electric resistance and the binder resin and is, therefore, suitable as a magnetic carrier for electrophotographic developer because it can exhibit an adequate electric resistance and a good stability of the electric resistance against an applied voltage.

What is claimed is:

1. Black magnetic iron oxide particles which comprise core particles and a surface layer formed on the respective core particles and which have an average particle diameter of 0.05 to 2.0 μm and an electric resistance value RM100 at an applied voltage of 100 V of not less than $1\times10^8$ Ω·cm.

2. Black magnetic iron oxide particles according to claim 1, wherein the black magnetic iron oxide particles comprise core particles and a surface layer formed on the respective core particles the surface layer comprises one or more elements selected from the group consisting of Al, Mg, Mn, Zn, Ni, Cu, Ti and Si, and the elements are present in an amount of 0.3 to 4.5% by weight in the surface layer.

3. Black magnetic iron oxide particles according to claim 1, wherein the black magnetic iron oxide particles have a water absorption Ma0.9 of not more than 15 mg/g.

4. Black magnetic iron oxide particles according to claim 1, wherein the black magnetic iron oxide particles have an electric resistance value RM10 at an applied voltage of 10 V which satisfies the relationship represented by the formula:

$$0.5 \leq RM100/RM10 \leq 1.$$

5. A magnetic carrier for electrophotographic developer comprising spherical magnetic composite particles obtained by dispersing black magnetic iron oxide particles as defined in claim 1 in a binder resin, wherein the magnetic carrier has an electric resistance value R100 at an applied voltage of 100 V of $1\times10^{8}$ to $1\times10^{14}$ Ω·cm, and an electric resistance value R300 at an applied voltage of 300 V which satisfies the relationship represented by the formula:

$$0.1 \leq R300/R100 \leq 1,$$

wherein the total content of the magnetic iron oxide particles in the spherical magnetic composite particles is 80 to 99% by weight based on the weight of the spherical magnetic composite particles.

6. A magnetic carrier for electrophotographic developer according to claim 5, wherein the binder resin is a phenol resin.

7. A magnetic carrier for electrophotographic developer according to claim 5, wherein a surface coating layer mainly comprising a resin is formed on a surface of the respective spherical magnetic composite particles.

8. A two-component electrophotographic developer comprising the magnetic carrier for electrophotographic developer as defined in claim 5.

9. A magnetic carrier for electrophotographic developer according to claim 5, having a saturation magnetization value of 40 to 100 $Am^2/kg$ when applying an external magnetic field of 795.8 kA/m (10 kOe).

10. A magnetic carrier for electrophotographic developer according to claim 5, having a saturation magnetization value of 71.3 to 100 $Am^2/kg$ when applying an external magnetic field of 795.8 kA/m (10 kOe).

11. A magnetic carrier for electrophotographic developer according to claim 5, wherein a total content of the magnetic iron oxide particles in the spherical magnetic composite particles is 85 to 99% by weight based on the weight of the spherical magnetic composite particles.

* * * * *